US005345067A

United States Patent [19]

Ohta et al.

[11] Patent Number: 5,345,067

[45] Date of Patent: Sep. 6, 1994

[54] COOKING MENU SELECTING DEVICE OF A HEATING APPARATUS

[75] Inventors: Nobuaki Ohta, Anjo; Takamichi Sujaku, Nagoya, both of Japan

[73] Assignee: Kabushiki Kaisha Toshiba, Kawasaki, Japan

[21] Appl. No.: 17,503

[22] Filed: Feb. 12, 1993

[30] Foreign Application Priority Data

Feb. 24, 1992 [JP] Japan ..... 4-036058
Apr. 28, 1992 [JP] Japan ..... 4-109698

[51] Int. Cl.[5] ..... H05B 6/68

[52] U.S. Cl. ..... 219/720; 219/506; 99/325; 345/44

[58] Field of Search ..... 219/10.55 B, 10.55 E, 219/506, 720; 340/766; 99/325

[56] References Cited

U.S. PATENT DOCUMENTS 4,028,517 6/1977 Tanaka et al. ..... 219/10.55 B
4,324,966 4/1982 Tanabe ..... 219/10.55 B
4,459,449 7/1984 Hirata ..... 219/10.55 B
4,517,428 5/1985 Matsushima ..... 219/10.55 B
4,590,350 5/1986 Ueda ..... 219/10.55 B
4,695,711 9/1987 McGeorge ..... 219/506

FOREIGN PATENT DOCUMENTS 0366137 10/1989 European Pat. Off. ..... H05B 6/68
3408436A1 3/1984 Fed. Rep. of Germany ... F24C 7/08
3642807A1 12/1986 Fed. Rep. of Germany ..... F24C 15/06

*Primary Examiner*—Philip H. Leung
*Attorney, Agent, or Firm*—Limbach & Limbach

[57] ABSTRACT

A heating apparatus such as microwave ovens includes a menu display for displaying a plurality of cooking menu groups each including a plurality of cooking menus, a menu selecting dial turned in one of two directions so that one of the cooking menu groups displayed on the menu display is selected, the menu selecting dial being turned in the other direction so that one cooking menu is selected from the selected cooking menu group, a heater for heating food to be cooked, and a heating control device for controlling the heater so that heating is automatically executed in accordance with the cooking menu selected by a turn of the menu selecting dial.

8 Claims, 17 Drawing Sheets

COOKING MENU SELECTING DEVICE OF A HEATING APPARATUS

BACKGROUND OF THE INVENTION

1. Field of the invention

This invention relates to a heating apparatus such as microwave ovens wherein an operation for selecting a desired cooking menu is improved.

2. Description of the prior art

In conventional microwave ovens, for example, desired one of a plurality of cooking menus is selected and heating is executed in accordance with the selected cooking menu. The microwave oven of this type comprises a plurality of selecting keys provided on an operation panel to correspond to the cooking menus respectively. Any one of the selecting keys is depressed so that a desired cooking menu is selected.

However, the number of the selecting keys has been increased with recent increase in the number of the cooking menus executed by the microwave oven, which has disadvantageously rendered the operation panel of the microwave oven large-sized.

The prior art has provided a countermeasure in which a single selecting key is repeatedly depressed so that the cooking menus are sequentially selected. However, the depression of the selecting key needs to be repeated by the number of times corresponding to the number of cooking menus depending upon the cooking menu to be selected. Consequently, the number of times of depressing the selecting key has been increased with the recent increase in the number of cooking menus executed by the microwave oven and accordingly, the selection of the cooking menu is much troublesome, which reduces the convenience of the microwave oven.

The prior art has provided another countermeasure which is a compromise between the above-described arrangements. FIG. 15 illustrates an operation panel I mounted on the front of a microwave oven embodying this countermeasure. The operation panel I includes a plurality of selecting keys 2 aligned vertically in its central portion. The selecting keys 2 correspond to a plurality of cooking menu groups respectively, such as "DAILY DISH" and "CONFECTION & BREAD." The operation panel 2 further includes a menu display section 3 disposed in the left-hand side of the selecting keys 2. The names of the cooking menus are printed on the surface of the menu display section 3. More specifically, the names of the cooking menus printed on the surface of the menu display section 3 include those of a plurality of cooking menus such as "BOILED GREEN VEGETABLE" and "BOILED EDIBLE ROOT" belonging to a cooking menu group of "DAILY DISH" and the names of a plurality of cooking menus such as "SPECIAL COOKIE COURSE" and "SPECIAL CAKE COURSE" belonging to a cooking menu group of "CONFECTION & BREAD." The menu display section 3 further includes light-emitting diodes (LED's) 4 corresponding to the printed cooking menus respectively.

When an automatic cooking is to be executed in the above-described microwave oven, a user depresses any one of the selecting keys 2 so that one cooking menu group is specified. Then, the user repeatedly depresses the selecting key 2 so that a desired cooking menu is selected. For example, when the user wants to select the cooking menu of "BEEF & POTATO STEW/-BOILED FOOD," the selecting key 2 corresponding to "DAILY DISH" is first depressed. In this case, LED 4 corresponding to "BOILED GREEN VEGETABLE" is actuated. When the selecting key 2 for "DAILY DISH" is further depressed twice, LED's 4 corresponding to "BOILED EDIBLE ROOT" and "BEEF & POTATO STEW/BOILED FOOD" are actuated in turn. Thereafter, upon depression of a start key 5, the automatic cooking is executed in accordance with a cooking program corresponding to the selected cooking menu of "BEEF & POTATO STEW/BOILED FOOD."

In accordance with the above-described arrangement, however, the increase in the number of executed cooking menus increases the number of names of the cooking menus printed on the menu display section 3, which complicates the contents displayed on the menu display section 3. Consequently, the user has some difficulty in selecting a desired cooking menu and the operation panel is rendered large-sized as well.

SUMMARY OF THE INVENTION

Therefore, an object of the present invention is to provide a heating apparatus wherein a desired cooking menu can be promptly selected from a number of cooking menus, the operation panel can be rendered small-sized, its convenience can be improved, and the displayed cooking menus can be readily perceived.

The present invention provides a heating apparatus comprising menu display means for displaying a plurality of cooking means divided into a plurality of groups, each group including a plurality of cooking menus, a menu selecting dial connected to the menu display means so that when rotatively moved in one of two directions, one of the cooking menu groups displayed on the menu display means is selected and so that when rotatively moved in the other direction, one cooking menu is selected from the selected cooking menu group, heating means for heating food to be cooked, and heating control means connected to the heating means and the menu selecting dial for controlling the heating means so that a heating operation is automatically executed in accordance with the cooking menu selected by rotative movement of the menu selecting dial.

When a cooking menu is to be selected in the above-described heating apparatus, first, the menu selecting dial is rotatively moved in the one direction so that one of a plurality of cooking menu groups on display is selected. In this case, the group to which a desired cooking menu belongs is selected. Thereafter, the menu selecting dial is rotatively moved in the other direction so that the desired cooking menu is selected from the previously selected cooking menu group. Thus, the menu selecting dial is rotatively moved for the selection of the cooking menu and accordingly, the operation for the selection of the cooking menu is rendered easy as compared with the arrangement that the menu selecting key is depressed a number of times. Consequently, the convenience of the heating apparatus can be improved. Furthermore, since a single dial is provided instead of a plurality of keys to perform their functions, the reduction in the number of parts and in the size of the operation panel can be achieved.

It is preferable that the menu display means have light transmissibility and that the heating apparatus further comprise light-emitting elements provided on the menu display means for representing the cooking menus respectively, backlights provided on a back face of the menu display means for illuminating the cooking menu groups respectively from behind the menu display means, and display control means for actuating the light-emitting element corresponding to the cooking menu selected by the rotative movement of the menu selecting dial and actuating the backlight corresponding to the cooking menu group to which the selected cooking menu belongs.

The name of the cooking menu group to which the cooking menu to be selected belongs is illuminated by the backlight from behind. Accordingly, the names of necessary cooking menus or a necessary cooking menu group is displayed brightly to become conspicuous. Thus, the user can easily perceive the names of the cooking menus.

The present invention also provides a heating apparatus comprising menu display means for displaying a plurality of cooking menus divided into a plurality of groups, each group including a plurality of cooking menus, the menu display means having light transmissibility, light-emitting elements provided on the menu display means for representing the cooking menus respectively, backlights provided on a back face of the menu display means for illuminating the cooking menu groups respectively from behind the menu displaying means, a menu selecting dial connected to the menu display means so that one of the cooking menus is selected when rotatively moved, display control means connected to the light-emitting elements and the backlights for actuating the light-emitting element corresponding to the cooking menu selected by the rotative movement of the menu selecting dial and actuating the backlight corresponding to the cooking menu group to which the selected cooking menu belongs, heating means for heating an object to be cooked, and heating control means connected to the heating means and the menu selecting dial for controlling the heating means so that a heating operation is automatically executed in accordance with the cooking menu selected by rotative movement of the menu selecting dial.

In the above-described heating apparatus, too, when the user rotatively moves the menu selecting dial, viewing the menu display means, the desired cooking menu corresponding to the actuated light-emitting element can be selected. Consequently, the convenience of the heating apparatus can be improved and the reduction in the number of parts and the size of the operation panel can be achieved. In the selection of the desired cooking menu, the backlight corresponding to the cooking menu group to which the desired cooking menu belongs is actuated so that the selected cooking menu group is illuminated from behind. Consequently, the cooking menus on display can be easily perceived by the user.

In the above-described heating apparatus, the menu selecting dial may at least have a central depressible portion and the heating may be initiated when the central depressible portion of the menu selecting dial is depressed. In this arrangement, the menu selecting dial for the selection of the cooking menu can also be used as a switch for the initiation of the heating. Consequently, the operation panel can be further rendered small-sized.

Furthermore, the menu display means may have a panel on which the menu selecting dial is mounted to be rotatively moved and depressible and the heating control means may control the heating means so that the heating operation is initiated when the menu selecting dial is depressed. Consequently, further reduction in the number of parts can be expected.

Furthermore, the menu selecting dial may comprise a generally annular rotatively operated section rotatively moved and a depressibly operated section provided inside the rotatively operated section. In this case, the central depressibly operated section can be designed not to be rotatively moved when the menu selecting dial is rotatively moved, though the number of parts is increased in this case as compared with the case where the whole of the dial is depressible. Consequently, characters or a figure on the front face of the depressibly operated section can be prevented from being rotatively moved, which improves its design.

Furthermore, the heating apparatus may further comprise cooking mode switching means for switching a cooking mode between automatic and manual cooking modes and cooking time setting means connected to the menu selecting dial and the cooking mode switching means or setting a cooking time period by the rotative movement of the menu selecting dial when the manual cooking mode has been selected by the cooking mode switching means. In this arrangement, the menu selecting dial can be used both for the selection of the cooking menu and for the setting of the cooking time period. Consequently, the number of parts can be further reduced and the operation panel can be further rendered small-sized.

In the above-described arrangement, the heating apparatus may further comprise dial function indicating means for indicating that the menu selecting dial has been operated either for the cooking menu selection or for the setting of the cooking time period and function indication means connected to the cooking mode switching means for controlling the dial function indicating means in accordance with the switching operation of the cooking mode switching means. In this arrangement, the dial function indicating means can provide a distinct indication as to which function the menu selecting dial is performing, the cooking menu selecting function or the cooking time period setting function.

Other objects of the present invention will become obvious upon understanding of the illustrative embodiments about to be described. Various advantages not referred to herein will occur to those skilled in the art upon employment of the invention in practice.

BRIEF DESCRIPTION OF THE DRAWINGS

The embodiments of the invention will be described with reference to the accompanying drawings in which.

DESCRIPTION OF THE PREFERRED EMBODIMENTS

Figure 1:
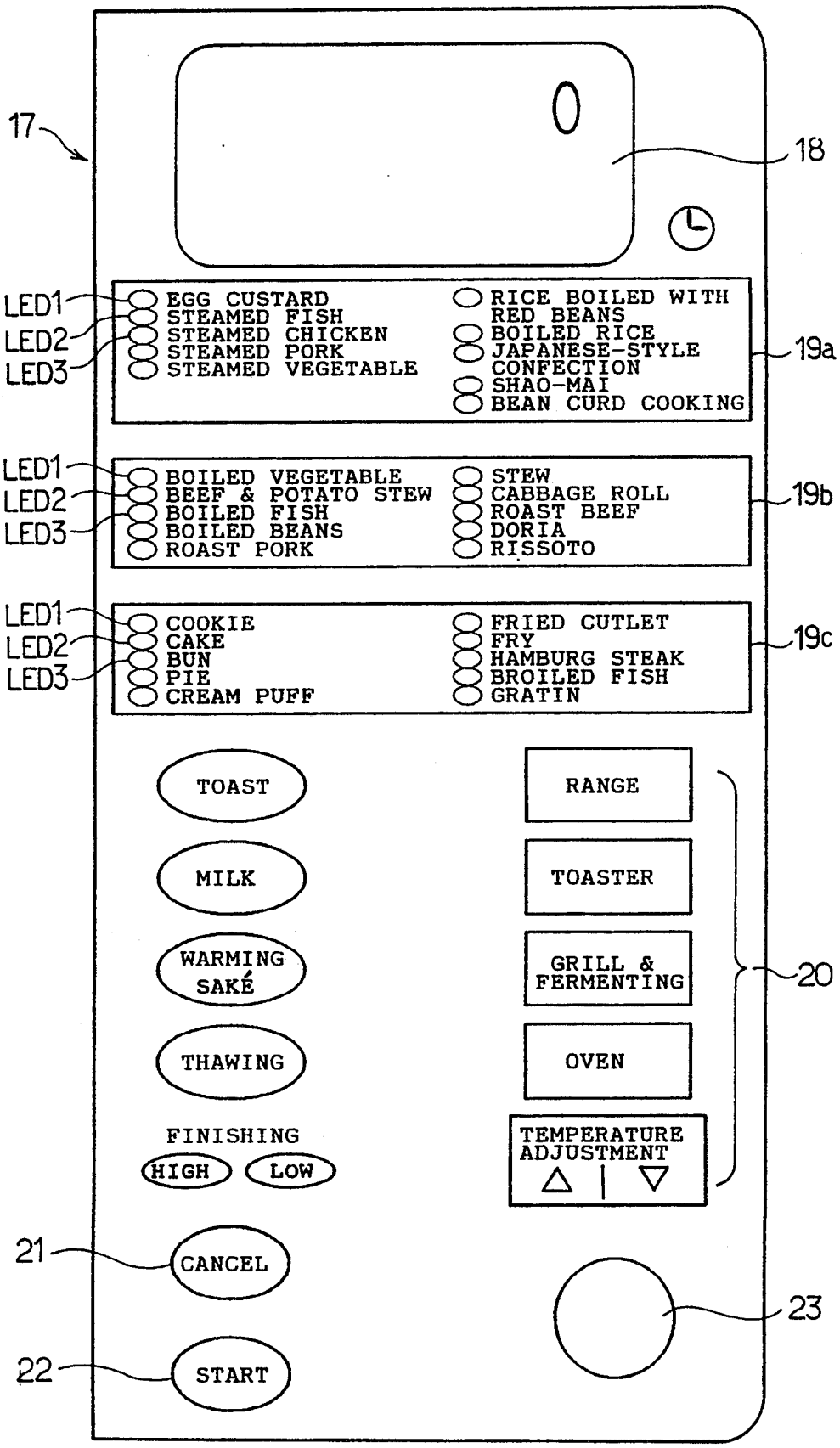
FIG. 1 is a front view of the operation panel of a microwave oven in accordance with a first embodiment of the invention.
Figure 2A:
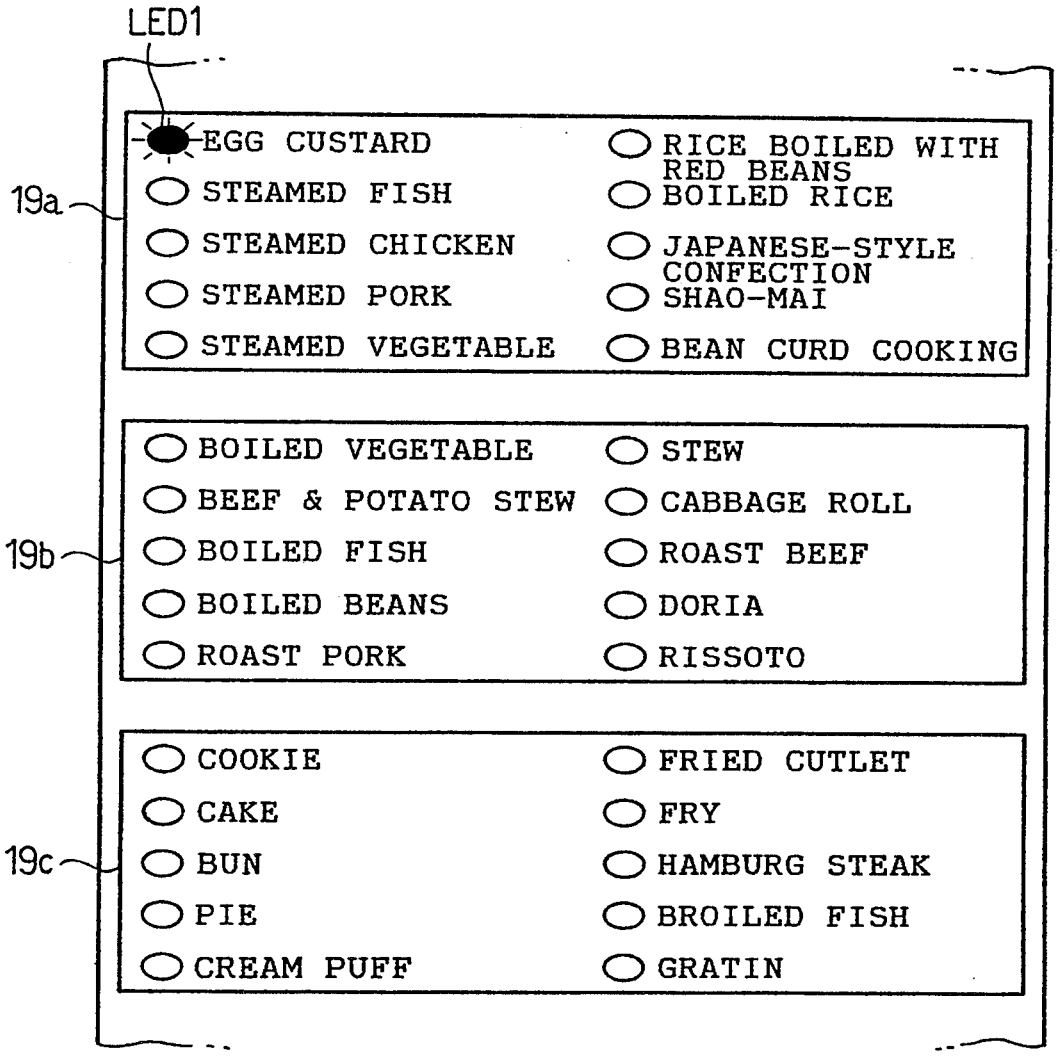
FIGS. 2(*a*)–2(*c*) are front views of the operation panel to explain the procedure for selecting one of a plurality of cooking menu groups.
Figure 2:
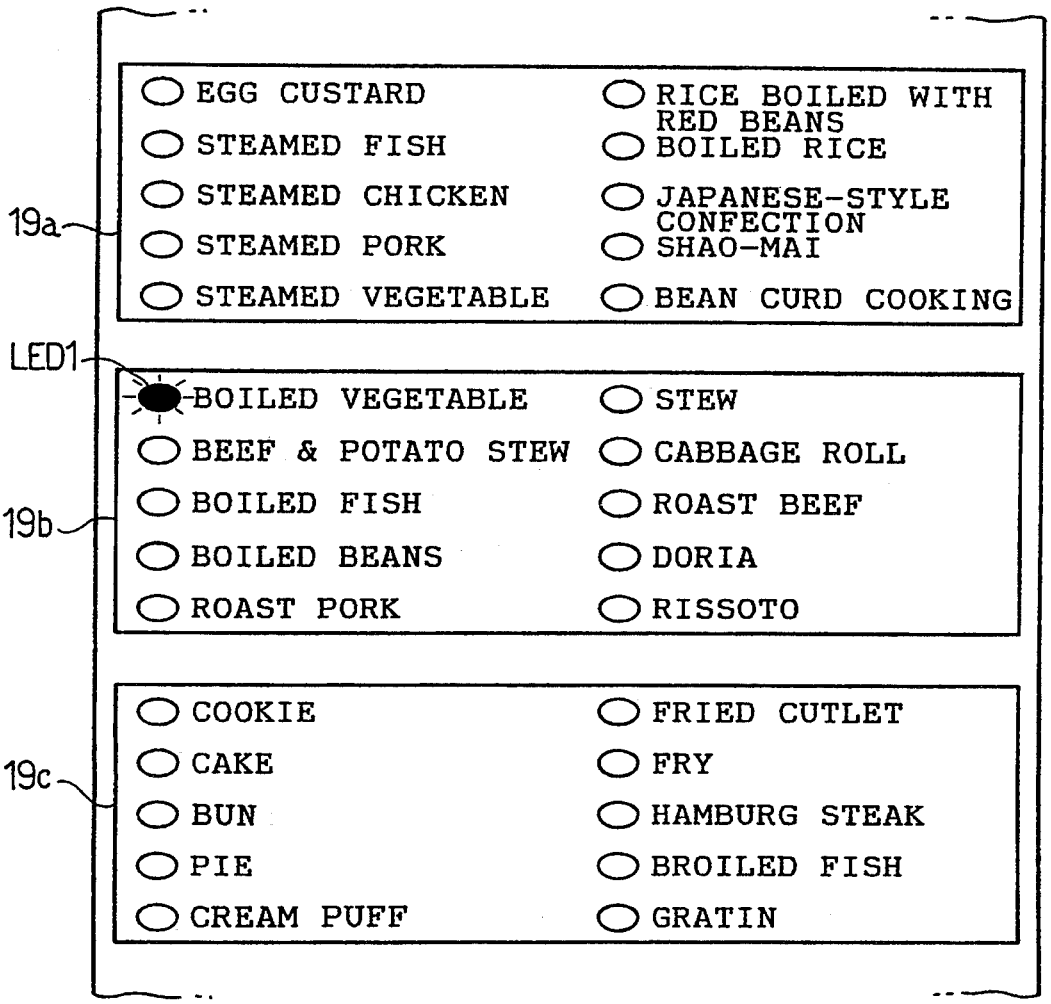
Figure 2:
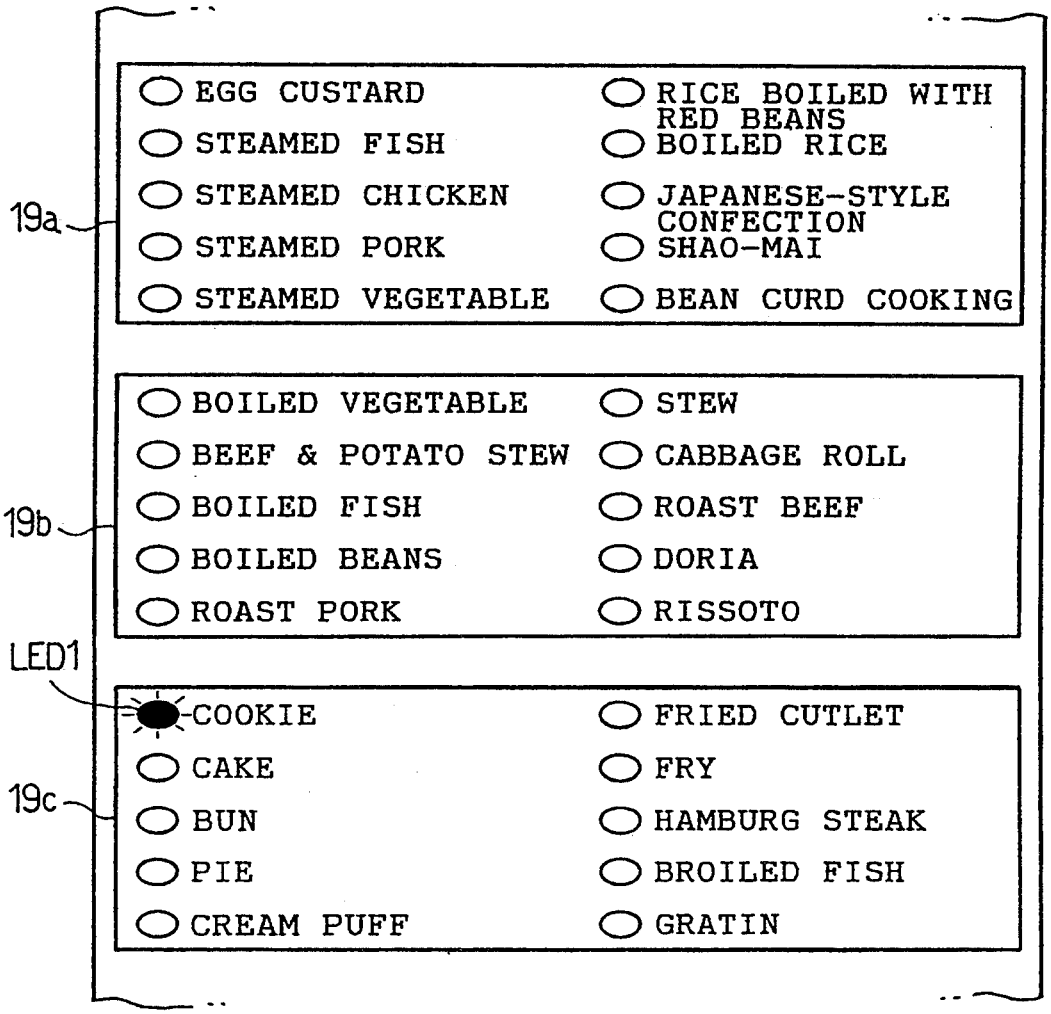
Figure 3A:
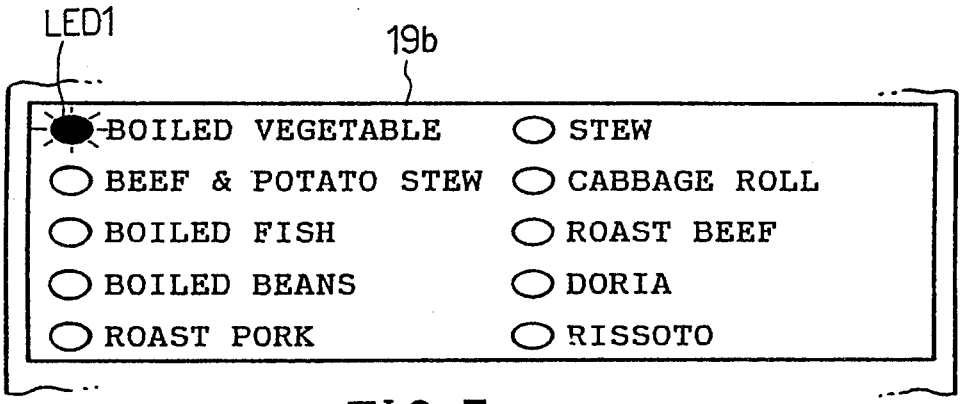
FIGS. 3(*a*)–3(*f*) are front views of the operation panel to explain the procedure for selecting one cooking menu from the selected cooking menu group.
Figure 3B:
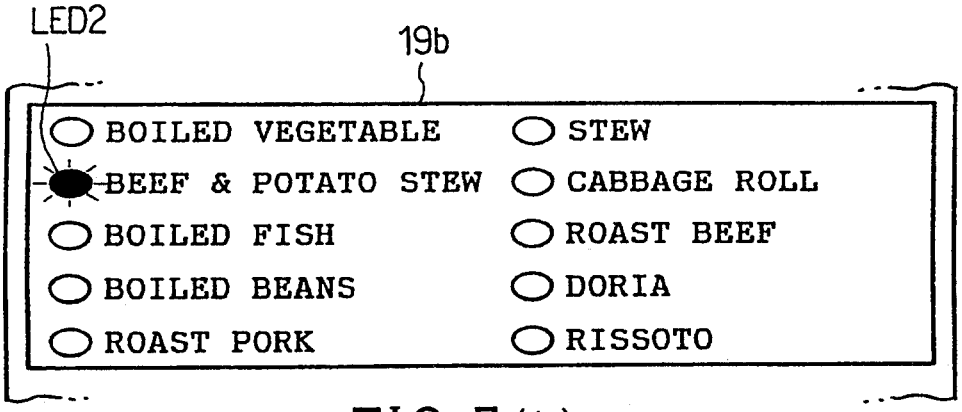
Figure 3C:
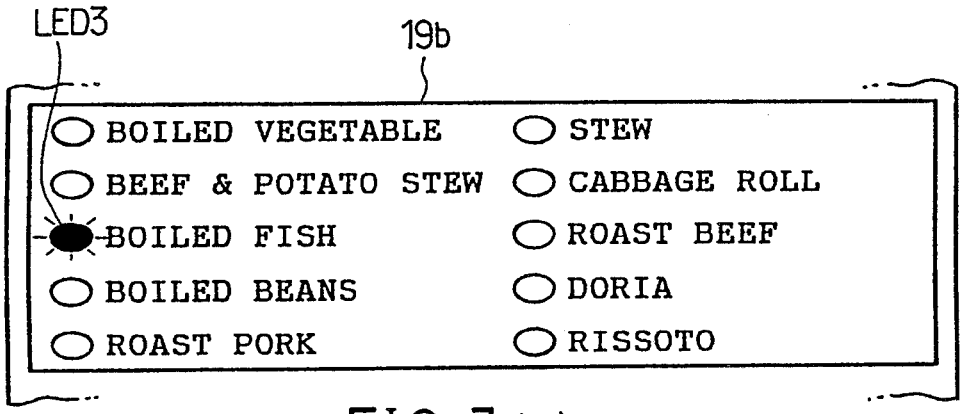
Figure 3D:
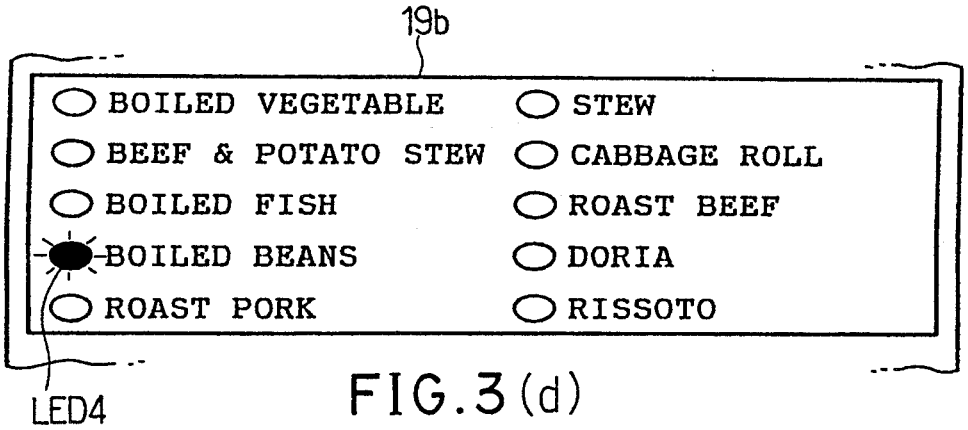
Figure 3E:
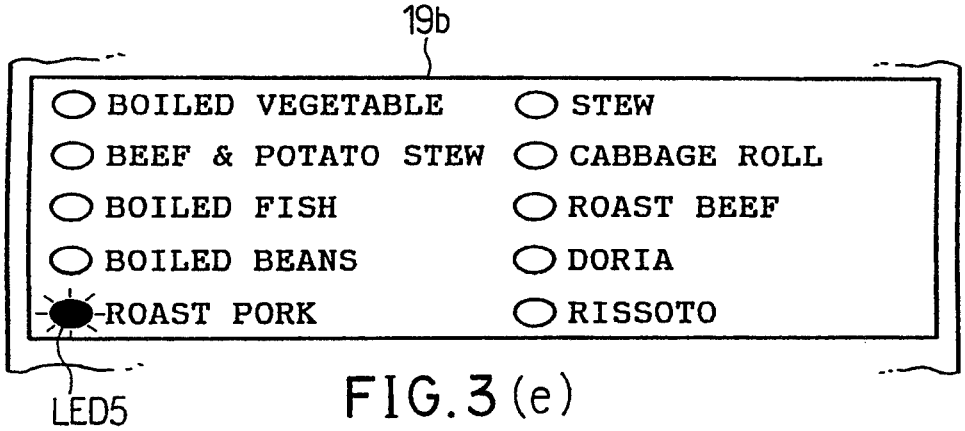
Figure 3F:
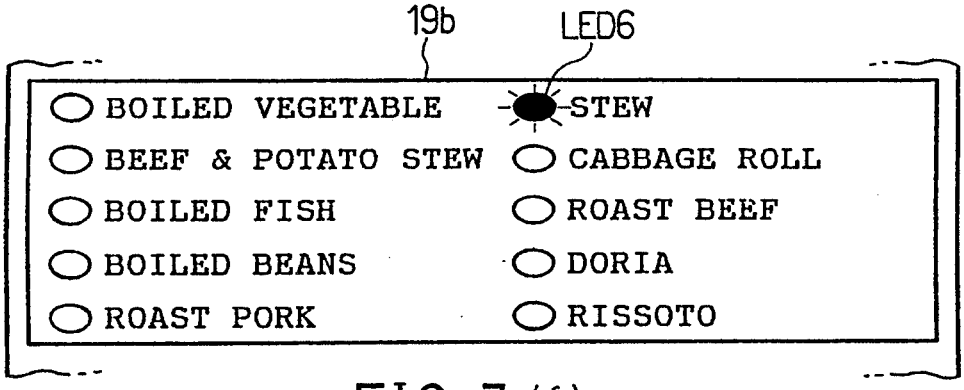

A first embodiment wherein the invention is applied to a microwave oven incorporating a magnetron and another heater will be described with reference to FIGS. 1 through 6. FIG. 5 shows an overall construction of the microwave oven. A cooking chamber 12 and a machine compartment (not shown) are defined right and left in an outer casing 11. A magnetron 13 (see FIG. 6) disposed in the machine compartment is energized to be oscillated in a range cooking so that a food contained in the cooking chamber 12 is heated. In an oven mode and a grill mode, an oven heater 14 and a grill heater 15 are energized respectively so that a food contained in the cooking chamber 12 is heated. Thus, the magnetron 13, the oven heater 14 and the grill heater 15 each serve as heating means.

Referring to FIG. 5, a door 16 for closing and opening the cooking chamber 12 and an operation panel 17 are mounted left and right on the front of the outer casing 11. A time display unit 18 is mounted in the upper portion of the operation panel 17 and menu display sections 19*a*, 19*b* and 19*c* are provided below the time display unit 18 in the operation panel 17, as shown in FIG. 1. The menu display sections 19*a*–19*c* serve as menu display means for displaying, for example, three cooking menu groups A, B and C, each of which groups includes a plurality of cooking menus. In the embodiment, the cooking menu group A includes a plurality of range cooking menus including steaming such as "EGG CUSTARD" and "BOILED RICE." The cooking menu group B includes a plurality of range cooking menus including boiling such as "BOILED VEGETABLE" and "STEW." The cooking menu group C includes a plurality of oven/grill cooking menus such as "COOKIE" and "HAMBURGER STEAK." Each of the menu display sections 19*a*–19*c* is provided with characters indicative of the name of each cooking menu and light-emitting diodes LED1, LED2, LED3 and so on for the respective cooking menus.

The menu display sections 19*a*–19*c* comprise a light-transmissible panel on which a number of names of cooking menus are printed. Backup lights 26*a*, 26*b* and 26*c* (see FIG. 6) are disposed at the rear of the menu display sections 19*a*–19*c* for illuminating the cooking menu groups A, B, C from behind respectively. In this regard, the cooking menu groups A, B, C are printed on the light-transmissible panel so as to be loomed brightly only when illuminated from behind by the respective backlights 26*a*–26*c* and the menu display sections 19*a*–19*c* are darkened when the respective backlights 26*a*–26*c* are turned off.

Figure 6:
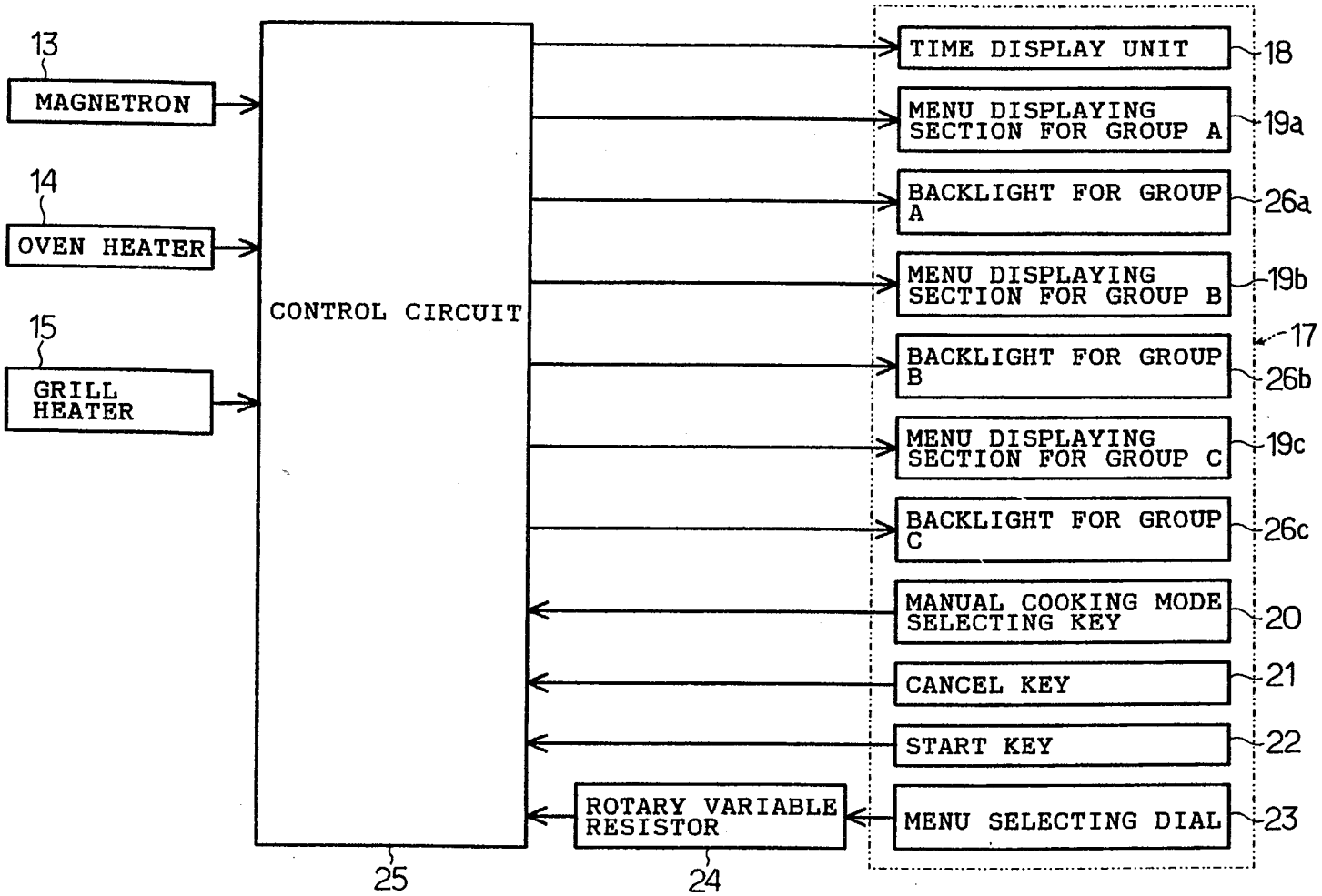
FIG. 6 is a block diagram schematically showing an electrical arrangement of the microwave oven.

Various manual cooking mode selecting keys 20, a cancel key 21 and a start key 22 and a menu selecting dial 23 are provided below the menu display section 19*c* in the operation panel 17. The menu selecting dial 23 is fixed to a rotating shaft of a rotary variable resistor 24 as shown in FIG. 6. A resistance value of the resistor 24 is converted to a corresponding voltage signal, which signal is supplied to a control circuit 25 composing heating control means. The control circuit 25 comprises a microcomputer, for example. The control circuit 25 determines in which direction the menu selecting dial 23 has been rotatively moved or turned, in the clockwise direction or in the counterclockwise direction, at the time of the turn of the menu selecting dial 23. The control circuit 25 further determines an angle of turn of the menu selecting dial 23. These determinations of the control circuit 25 are based on variations of the resistance value or the voltage signal supplied thereto from the rotary variable resistor 24.

Figure 4:
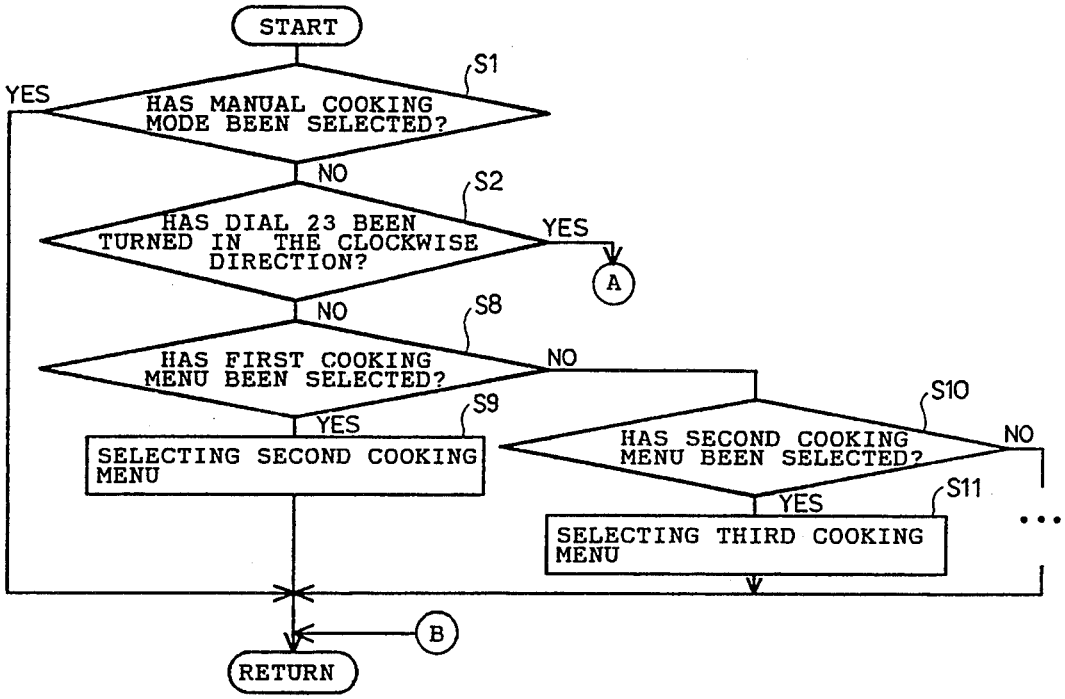
FIGS. 4(*a*) and 4(*b*) is a flowchart for explaining the control manner.
Figure 4:
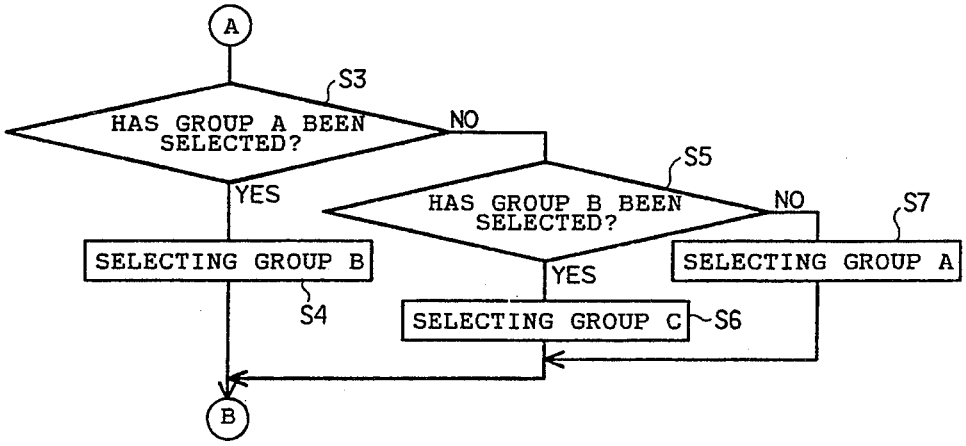
Figure 5:
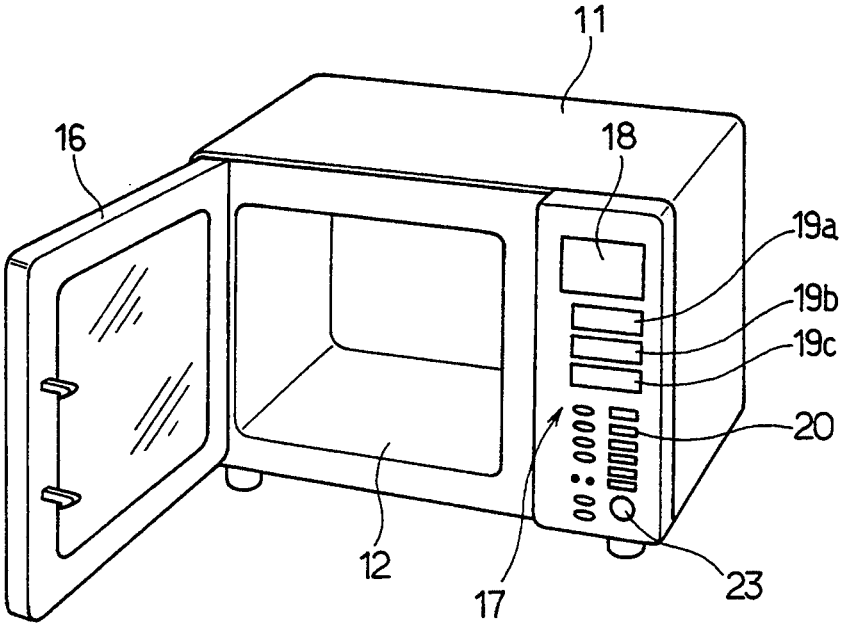
FIG. 5 is a perspective view of the microwave oven.

Furthermore, the control circuit 25 controls the menu display sections 19*a*–19*c* and the backlights 26*a*–26*c* in accordance with a control program as shown in FIGS. 4(*a*) and (*b*) as follows. First, the control circuit 25 determines whether or not the manual cooking mode by the manual cooking mode selecting key 20 has been selected, at step S1. When determining that the manual cooking mode has been selected, the control circuit 25 does not perform the control of the menu display sections 19*a*–19*c*, completing the control program of FIG. 4(*a*) and 4(*b*).

On the other hand, when an automatic cooking mode is to be executed, the user turns the menu selecting dial 23, for example, in one or the clockwise direction so that desired one of the cooking menu groups A, B, C is selected. In this case, it is determined in the negative at step S1 and the control circuit 25 then advances to step S2 where it is determined whether the menu selecting dial 23 has been turned in the clockwise direction or not. When the menu selecting dial 23 has been turned in the clockwise direction by a predetermined angle of turn (20 or 30 degrees, for example), the control circuit 25 determines in the affirmative in step S2, advancing to step S3. The control circuit 25 determines at step S3 whether the cooking menu group A has been selected or not or whether the first light-emitting element LED1 of the menu display section 19*a* is being actuated or not. When determining in the affirmative at step S3, the control circuit 25 operates to select the cooking menu group B, to actuate the first light-emitting element LED1 of the menu display section 19*b* and to actuate the backlight 26*b* so that the cooking menu group B is illuminated from behind to be brightly loomed, at step S4.

When determining in the negative at step S3, the control circuit 25 advances to step S5 where it is determined whether the cooking menu group B has been selected or not or whether the first light-emitting element LED1 of the cooking menu group 19*b* is being actuated or not. When determining in the affirmative at step S5, the control circuit 25 operates to select the cooking menu group C, to actuate the first light-emitting element LED1 of the cooking menu group C and to actuate the backlight 26*c* so that the cooking menu group C is illuminated from behind to be brightly loomed, at step S6. On the other hand, when determining in the negative at step S5, the control circuit 25 advances to step S7 where the cooking menu group A is selected, the first light-emitting element LED1 of the menu display section 19*a* is actuated and the backlight 26*a* is actuated so that the cooking menu group A is illuminated from behind to be brightly loomed.

In the control manner as described above, when the menu selecting dial 23 has been turned in the clockwise direction, the first light-emitting elements LED1 of the menu display sections 19*a*–19*c* are sequentially actuated in this order and one of the cooking menu groups A, B, C is sequentially selected in this order. Each selected cooking menu group is meshed in FIG. 2.

Subsequently, the menu selecting dial 23 is turned in the other or the counterclockwise direction so that a desired cooking menu is selected from the previously selected cooking menu group. When the menu selecting dial 23 is turned in the counterclockwise direction by the predetermined angle of turn, the control circuit 25 determines in the negative at step S2 and advances to step S8 where it is determined whether the first cooking menu has been selected or not or whether the first light-emitting element LED1 is being actuated or not. When determining in the affirmative at step S8, the control circuit 25 operates to select the second cooking menu and to actuate the second light-emitting diode LED2, at step S9, as shown in FIG. 3(*b*).

On the other hand, when determining in the negative at step S8, the control circuit 25 advances to step S10 where it is determined whether the second cooking menu has been selected or not or whether the second light-emitting element LED2 is being actuated or not. When determining in the affirmative at step S10, the control circuit 25 operates to select the third cooking menu and to actuate the third light-emitting element LED3, at step S11, as shown in FIG. 3(*c*). When determining in the negative at step S10, the control circuit 25 repeats the above-described processing.

In the above-described control manner, the light-emitting elements LED1, LED2, LED3 and so on are sequentially actuated in this order as shown in FIGS. 3(*a*)–3(*f*) when the menu selecting dial 23 is rotatively moved in the counterclockwise direction, whereby a desired cooking menu is selected. Subsequently, upon depression of the start key 22, the control circuit 25 controls the magnetron 13, the oven heater 14 or the grill heater 15 in accordance with the cooking menu selected by a turn of the menu selecting dial 23, whereby the automatic cooking is performed.

In accordance with the above-described embodiment, the menu selecting dial 23 is turned in one or the clockwise direction so that one of a plurality of cooking menu groups A, B, C is selected. Subsequently, the menu selecting dial 23 is turned in the other or counterclockwise direction so that one cooking menu is selected from the previously selected cooking menu group. Consequently, troublesomeness due to repeated depressing of the key in selection of the desired cooking menu in the prior art is eliminated. Furthermore, the convenience of the microwave oven can be improved since a desired cooking menu can be promptly selected from a number of cooking menus by a turn of the single menu selecting dial 23.

Although three cooking menu groups are provided in the foregoing embodiment, two, four or more cooking menu groups may be provided. Furthermore, each of the first light-emitting elements LED1 of the respective menu display sections 19*a*–19*c* is actuated when each cooking menu group has been selected. Alternatively, an exclusive indication element for providing an indication about the selection of the cooking menu may be employed, for example. Furthermore, the menu selecting dial 23 is turned in the clockwise direction for the selection of one of the cooking menu groups and it is turned in the counterclockwise direction for the selection of desired one of the cooking menus. However, the dial 23 may be turned in the counterclockwise direction for the selection of one of the cooking menu groups and it may be turned in the clockwise direction for the selection of desired one of cooking menus. Additionally, although the invention is applied to the microwave oven with the magnetron and another heater, the invention may be applied to a microwave oven with a magnetron but without a heater, an electric oven or other heating apparatus.

Figure 10:
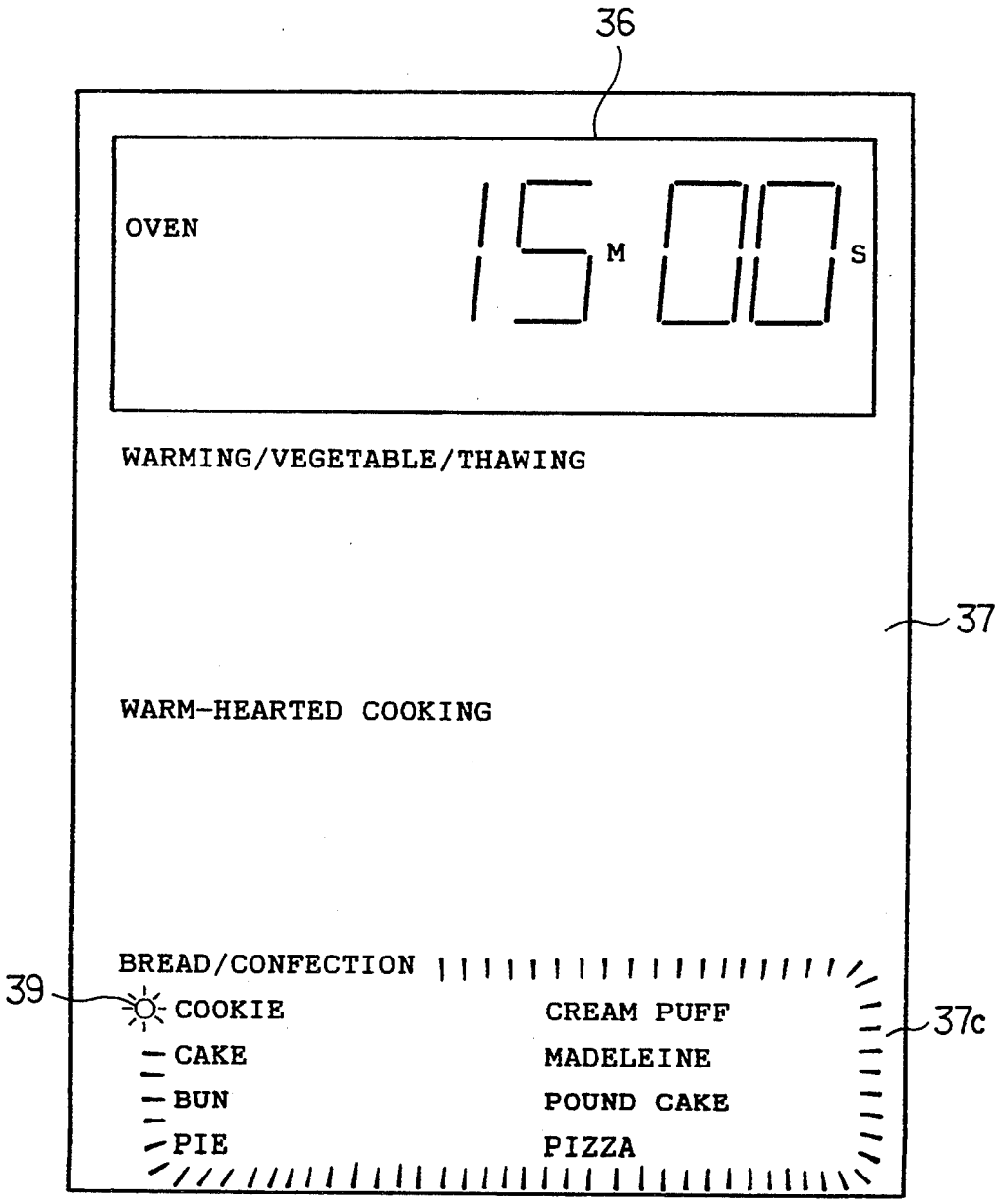
FIG. 10 is a front view of the cooking menu display section with its lower portion illuminated.
Figure 11:
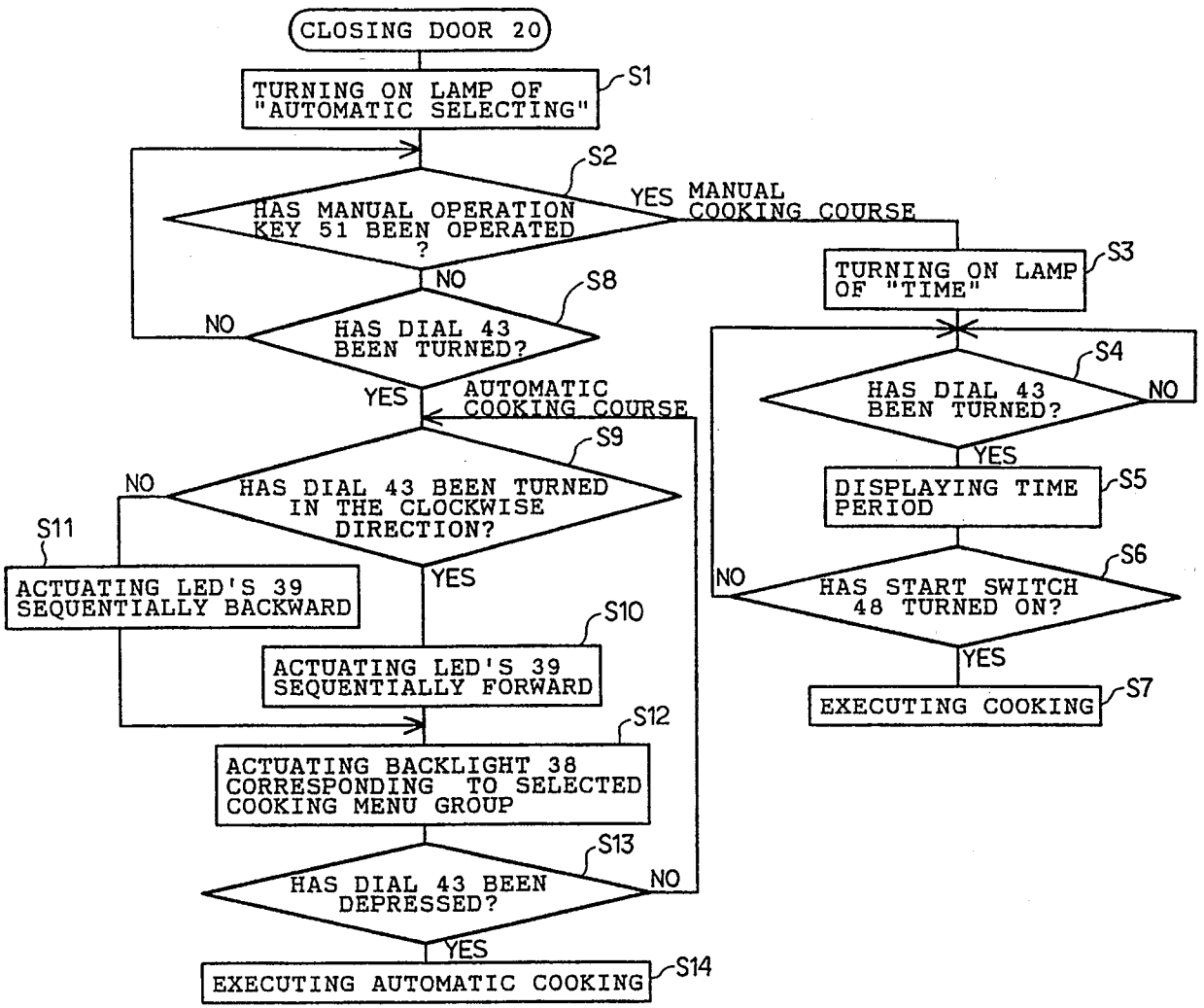
FIG. 11 is a flowchart showing the procedure for selecting the cooking menu.
Figure 12:
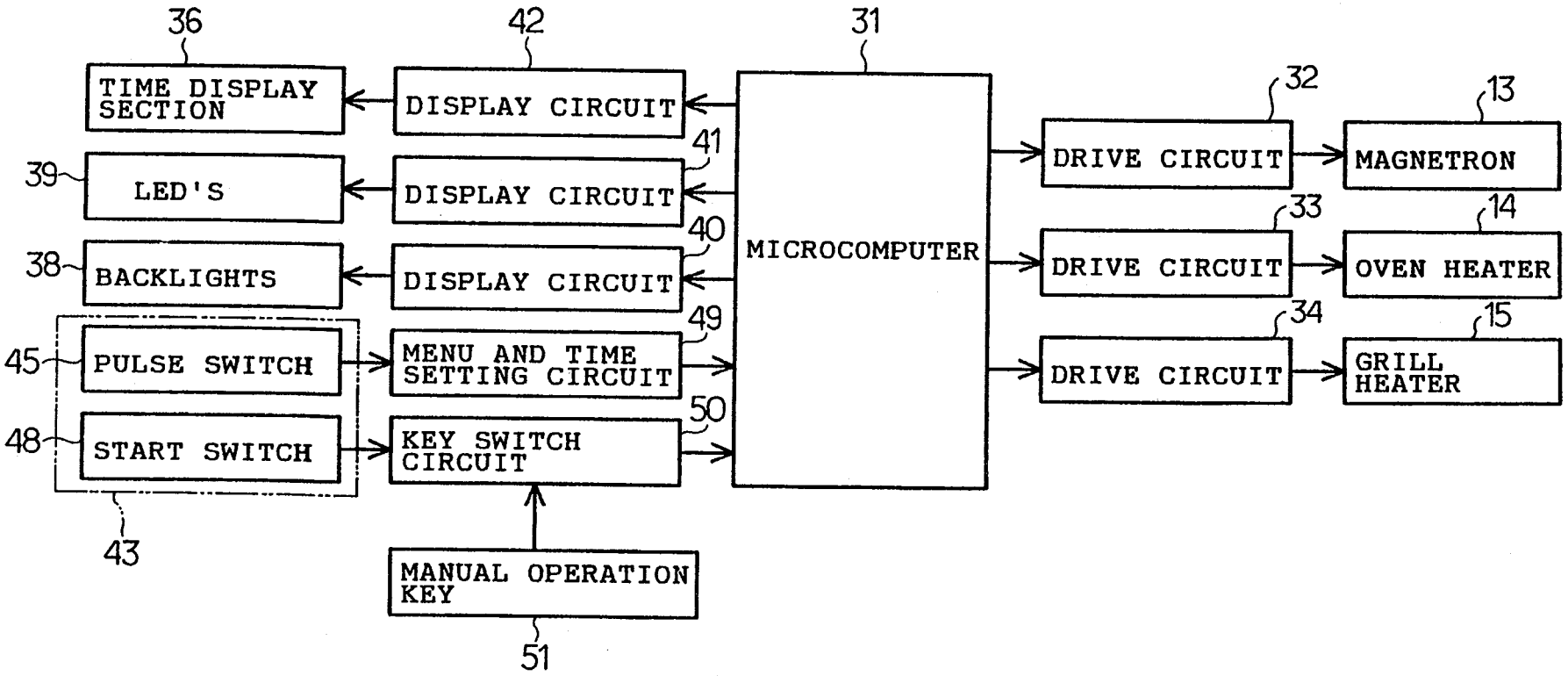
FIG. 12 is a block diagram schematically showing an electrical arrangement of the microwave oven of the second embodiment.

FIGS. 7 through 13 illustrate a second embodiment of the invention. Identical parts are labeled by the same reference numerals as in the first embodiment and the difference between the first and second embodiments will be described. Referring to FIG. 12, the oven heater for the oven cooking and the grill heater 15 for the grilling are disposed in the cooking chamber 12 and the magnetron 13 for the range cooking and the like are provided in the machine compartment. The magnetron 13, the oven heater 14 and the grill heater 15 are controlled via drive circuits 32, 33 and 34 respectively by a microcomputer 31 provided in the machine compartment, as shown in FIG. 12. The microcomputer 31 composes both the heating control means and display control means. The microcomputer 31 controls the magnetron 1, the oven heater 14 and the grill heater 15 in accordance with the cooking menu selected in the manner as will be described later so that the food is automatically cooked.

A time display section 36 is provided in the upper portion of an operation panel employed instead of the operation panel 17 for displaying the cooking time period and the like in the digital mode. A cooking menu display section 37 serving as menu display means is provided below the time display section 36. The cooking menu display section 37 comprises the light-transmissible panel on which a number of names of cooking menus are printed. These cooking menus are classified into three cooking menu groups of "WARMING-/VEGETABLE/THAWING," "WARM-HEARTED COOKING" and "BREAD/CONFECTION" respectively and printed on the upper, middle and lower portions 37*a*, 37*b* and 37*c* of the cooking menu display section 37 respectively. More specifically, the name of the cooking menu group, "WARMING-/VEGETABLE/THAWING," is printed at the top of the upper portion 37*a*. Below this name, the names of the cooking menus such as "RICE," "SIDE DISHES" and the like are printed in two rows. The name of the cooking menu group, "WARM-HEARTED COOKING," is printed at the top of the middle portion 37*b* and the names of the cooking menus, "BOILED RICE," "RICE BOILED WITH RED BEANS" and the like are printed in two rows below the group name on the middle portion 37*b*. In the same manner, the name of the cooking menu group, "BREAD/CONFECTION," is printed at the top of the lower portion 37*c* and the names of the cooking menus, "COOKIE," "CAKE" and the like are printed in two rows below the group name on the lower portion 37*c*.

Three backlights 38 (see FIG. 12) are provided at the rear of the cooking menu display section 37 so as to correspond to the upper, middle and lower portions 37*a*, 37*b*, 37*c* respectively. The names of the cooking menu groups are printed so as to be usually visible to the user regardless of turn-on and turn-off of the backlights 38. On the other hand, the name of each cooking menu is brightly loomed only when each corresponding backlight 38 is turned on to illuminate it from behind. Portions of the cooking menu display section 37 on which the names of the cooking menus are printed are darkened when the respective corresponding backlights are turned off.

Light emitting elements or LED's 39 are provided on the cooking menu display section 37 representing the cooking menus respectively. The backlights 38 and LED's 39 are controlled via display circuits 40 and 41 respectively by the microcomputer 31, as shown in FIG. 12. When the user has selected one of the cooking menus, one of LED's 39 corresponding to the selected cooking menu is selectively actuated and one of the backlights 38 corresponding to the cooking menu group to which the selected cooking menu belongs is selectively actuated, as will be described in detail later. Accordingly, the microcomputer 31 serves as the display control means. The time display section 36 is also controlled via a display circuit 42 by the microcomputer 31.

Figure 7:
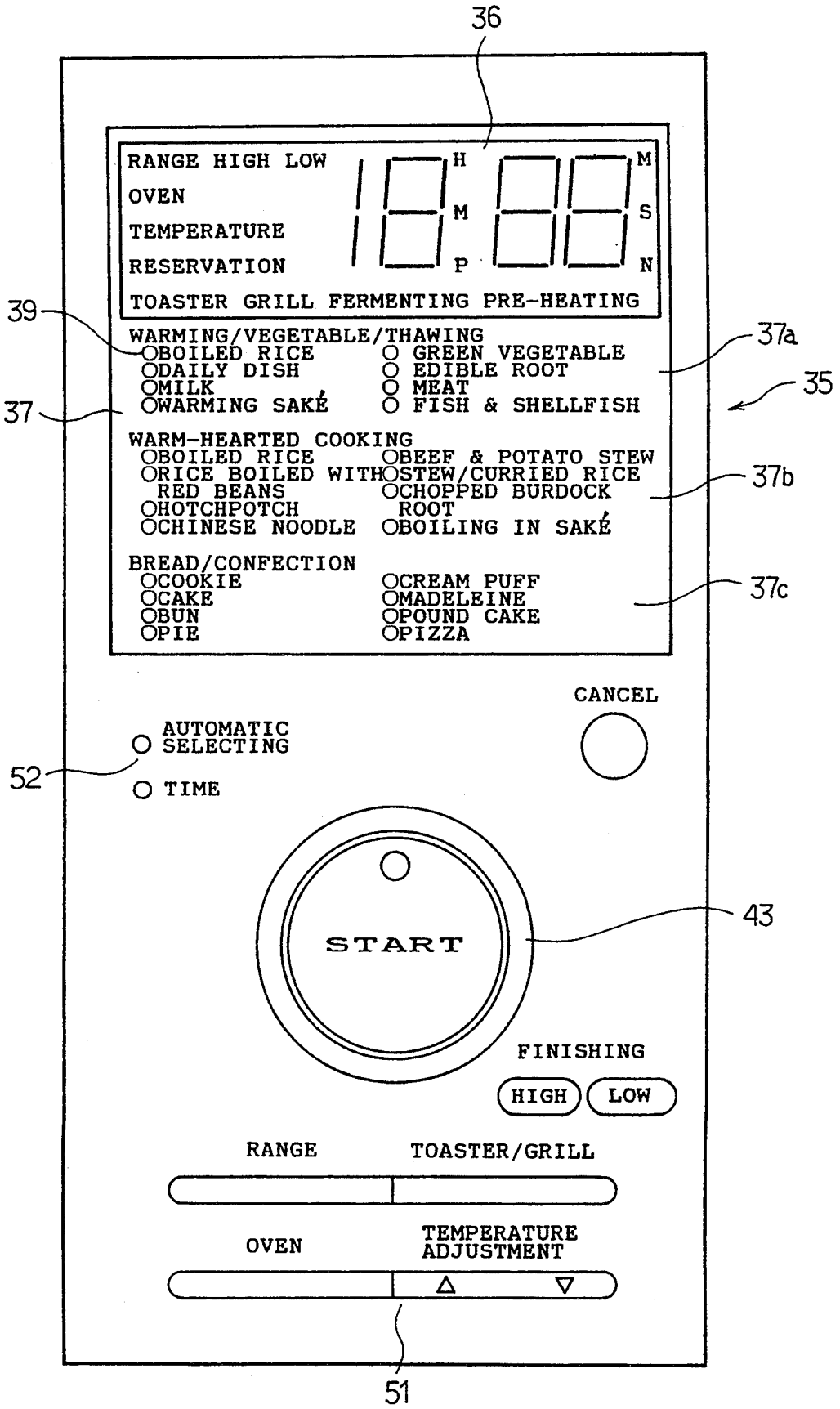
FIG. 7 is a front view of the operation panel of the microwave oven in accordance with a second embodiment of the invention.
Figure 13:
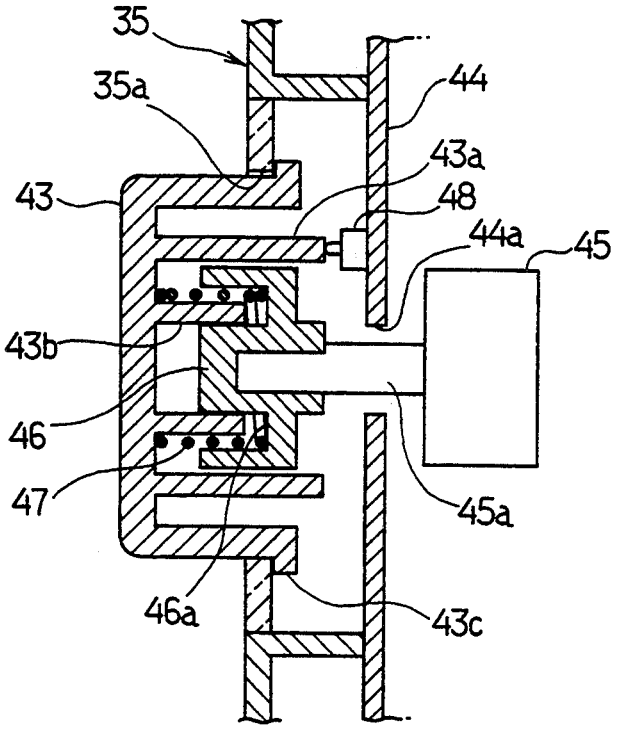
FIG. 13 is a longitudinally sectional side view of the menu selecting dial and its peripheral portion.

Referring now to FIG. 7, a menu selecting dial 43 operated for the user to select a desired cooking menu is provided in the lower portion of the operation panel 35. The menu selecting dial 43 is rotatively movable or turnable and depressible. More specifically, the menu selecting dial 43 has a closed end and is formed into a short cylindrical shape as shown in FIG. 13. The dial 43 is inserted in a circular mounting hole 35*a* for rotative movement and has in its inside an outer annular wall 43*a* and an inner annular wall 43*b*. A printed wiring board 44 is mounted on the rear of the operation panel 35. A pulse switch 45 is provided behind the printed wiring board 44. The pulse switch 45 comprises a rotary encoder, for example, and has a rotating shaft 45*a* protruded forward through a through-hole 44*a* formed in the printed wiring board 44.

A mount 46 is fixed to a front end of the rotating shaft 45*a* of the pulse switch 45. The mount 46 has in its front side a fitting groove 46*a* in which the inner annular wall 43*b* of the menu selecting dial 43 is fitted. In this condition, the mount 46 is rotatively moved with the menu selecting dial 43, which dial 43 is movable back and forth with respect to the mount 46. A coil spring 47 is interposed between the menu selecting dial 43 and the mount 46 so that the menu selecting dial 43 is urged forward by the coil spring 47. The menu selecting dial 43 has a flange 43*c* integrally formed on the rear end of its outer peripheral wall. The flange 43*c* is caused to butt against the rear open edge of the mounting hole 35*a* for the purpose of preventing the menu selecting dial from falling off.

A start switch 48 is mounted on the front side of the printed wiring board 44 to be opposed to the rear end of the outer annular wall 43*a* of the menu selecting dial 43. The start switch 48 is usually off and is turned on when the menu selecting dial 43 is depressed to be moved backward. Thus, the pulse switch 45 is operated when the menu selecting dial 43 is turned, thereby generating a pulse signal in accordance with an angle and direction of turn of the menu selecting dial 43. The pulse signal is supplied via a menu and time setting circuit 49 (see FIG. 12) to the microcomputer 31. The menu selecting dial 43 also serves as a cooking start button, and the start switch 48 is turned on when the dial 43 is depressed. Consequently, a switch signal generated by the start switch 48 is supplied via a key switch circuit 50 to the microcomputer 31.

The microcomputer 31 is provided with cooking programs corresponding to the respective cooking menus so that an automatic cooking is executed in accordance with the cooking menu selected by the user. Upon a turn of the menu selecting dial 43, the microcomputer 43 operates to actuate LED's 39 sequentially and one of the backlights 38 in accordance with the rotation angle of the dial 43. The user stops turning the dial 43 when LED 39 representing a desired cooking menu has been actuated. In this condition, when the dial 43 is depressed, the cooking is automatically executed in accordance with the selected cooking menu.

Below the menu selecting dial 43 are provided manual operation keys 51 for executing a manual cooking wherein the modes of the cooking, the cooking time period and the like are set by the user. The manual operation keys 51 include "RANGE," "TOASTER," "OVEN," "TEMPERATURE ADJUSTMENT" keys and the like. As shown in FIG. 12, signals generated by these manual operation keys 51 are also supplied via the key switch circuit 50 to the microcomputer 31. When the manual cooking mode has been selected, the functions of the menu selecting dial 43 are switched to those for setting the time periods so that the cooking time period can be set when the dial 43 is turned. More specifically, two function-indicating lamps 52 are provided on the left-hand upper side of the menu selecting dial 43 on the operation panel 35 for indicating the current function of the dial 43. The selection of the cooking menu as described above can be performed by a turn of the dial 43 while the function-indicating lamp 52 indicative of "AUTOMATIC SELECTING" is on. The time setting can be performed by a turn of the dial 43 while the function-indicating lamp 52 representing "TIME" is on. In the time setting, the set time is incremented by the turn of the menu selecting dial 43 in the clockwise direction and it is decremented by the turn of the dial 43 in the counterclockwise direction. The set time is displayed on the time display section 36.

The operation of the above-described microwave oven will be described with further reference to FIG. 11. When a food to be cooked is contained in the cooking chamber 12 and the door 16 is then closed, the microcomputer 31 performs the control in the procedure as shown in the flowchart of FIG. 11. Upon closure of the door 16, the function-indicating lamp 52 of "AUTOMATIC SELECTING" is turned on at step S1. When any one of the manual operation keys 51 is depressed for the setting of the manual cooking mode at step S2, the microcomputer 31 determines that the manual cooking course has been selected and the function-indicating lamp 52 of "TIME" is turned on with turn-off of the other lamp 52, at step S3. Subsequently, upon the turn of the menu selecting dial 43 at step S4, the cooking time period is displayed on the time display section 36 in accordance with an amount of turn of the dial 43 at step S5. The user stops turning the dial 43 when an appropriate time period has been displayed. Thus, the cooking mode and the time period are set. Then, upon depression of the menu selecting dial 43, the start switch 48 is turned on at step S6 and the cooking operation is executed in accordance with the set cooking mode and time period, at step S7.

On the other hand, the microcomputer 31 determines that the automatic cooking course has been selected when the user turns the menu selecting dial 43 at step S8 without depressing it at step S2. LED's 39 representing the respective cooking menus of the menu display section 37 are sequentially actuated one by one upon a turn of the menu selecting dial 43 by the user. When the menu selecting dial 37 is turned in the clockwise direction or when the microcomputer 31 determines in the affirmative at step S9, actuation of LED's 39 sequentially proceeds from the one representing the uppermost cooking menu, "BOILED RICE" to the one representing the cooking menu, "DAILY DISH" and so on, at step S10. When the menu selecting dial 43 is turned in the counterclockwise direction or when the microcomputer 31 determines in the negative at step S9, the actuation of LED's 39 proceeds in the opposite direction, at step S11. That is, when the menu selecting dial 43 is turned in the counterclockwise direction in the state that LED 39 representing the cooking menu of "BOILED RICE," LED 39 representing the last cooking menu, "PIZZA," is actuated. Upon further turn of the dial 43, LED's 39 representing the cooking menus, "POUND CAKE," "MADELEINE" and so on are sequentially actuated in this order. The user selects one of the cooking menus on the cooking menu display section 37 by actuation of LED 39.

Figure 8:
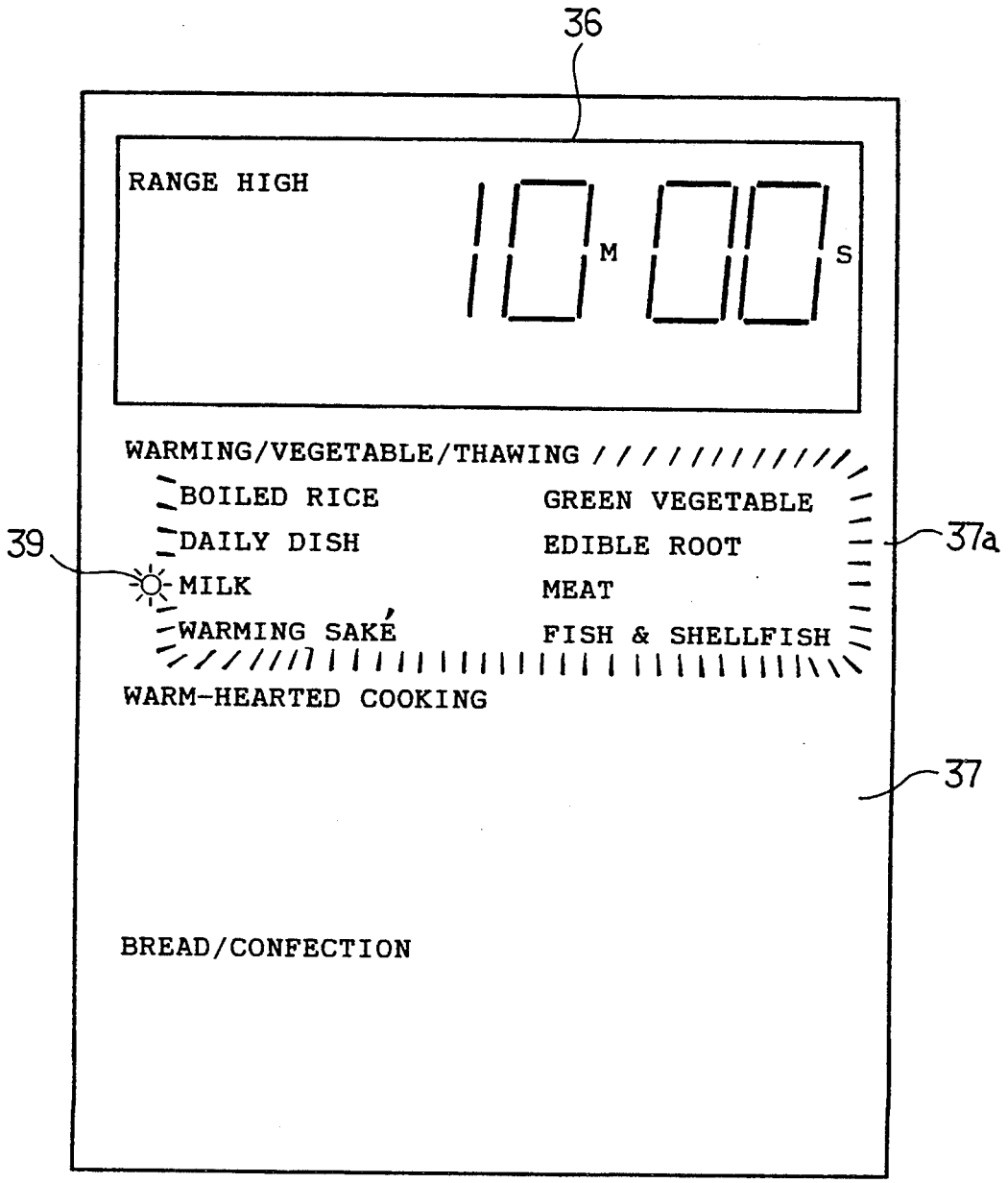
FIG. 8 is a front view of the cooking menu display section of the operation panel with its upper portion illuminated.
Figure 9:
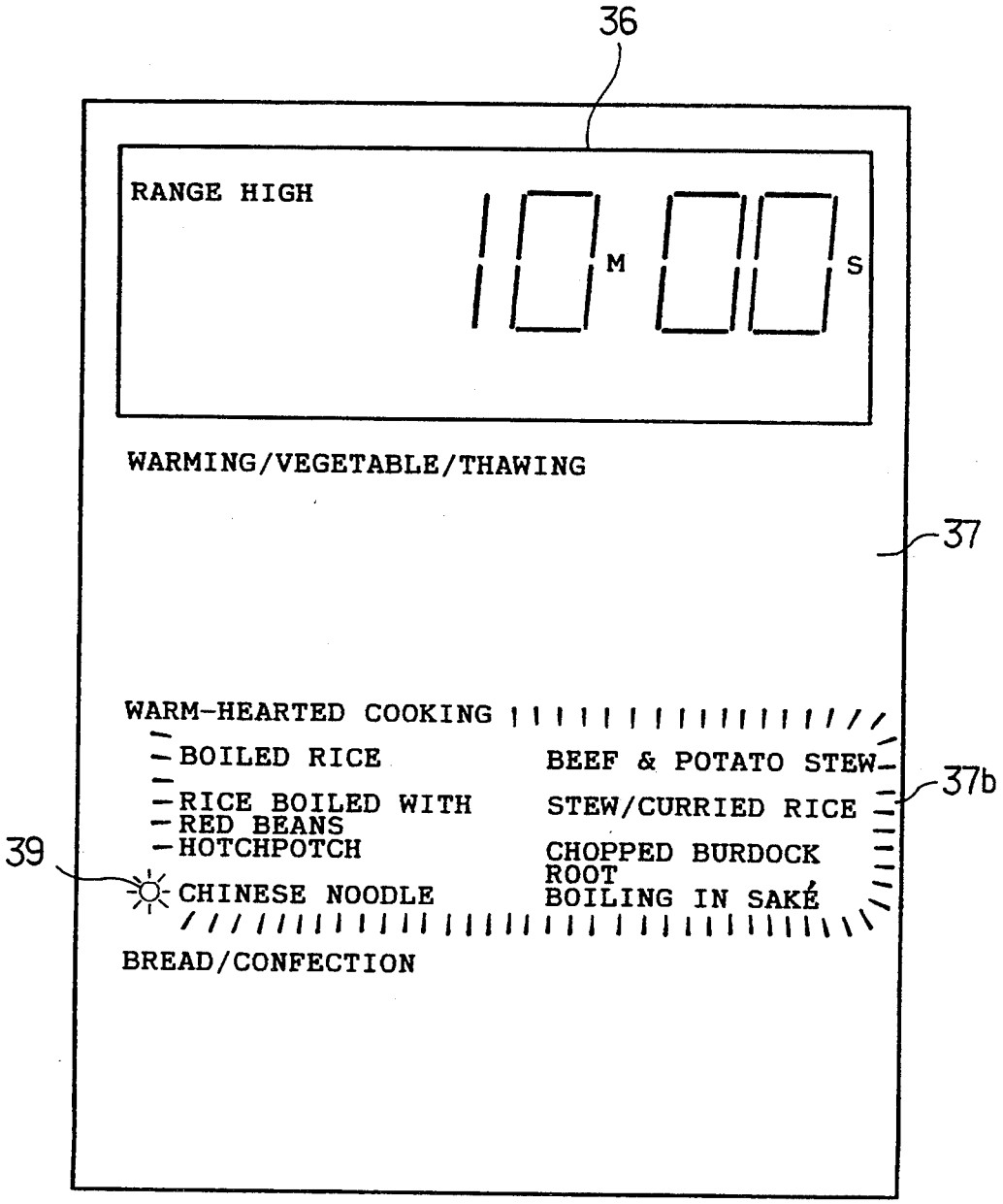
FIG. 9 is a front view of the cooking menu display section with its middle portion illuminated.

One of the backlights 38 is turned on upon actuation of LED 39 at step S12. In this regard, one of the backlights 38 is selectively turned on so that the cooking menu group to which the cooking menu whose LED 39 is on is illuminated by the backlight 38 from behind, whereby the names of the cooking menus in the cooking menu group are loomed brightly. More specifically, the upper portion 37*a* of the menu display section 37 is illuminated by the corresponding backlight 38 while one of LED's 39 for the cooking menus belonging to the group of "WARMING/VEGETABLE/THAWING" from "BOILED RICE" to "FISH & SHELLFISH" is on, as shown in FIG. 8. The middle portion 37*b* is illuminated by the corresponding backlight 38 while one of LED's 39 for the cooking menus belonging to the group of "WARM-HEARTED COOKING" from "BOILED RICE" to "STEAMING IN SAKE" is on, as shown in FIG. 9. The lower portion 37*c* is illuminated by the corresponding backlight 38 while one of LED's 39 for the cooking menus belonging to the group of "BREAD & CAKE" from "COOKIE" to "PIZZA" is on, as shown in FIG. 10. When the menu selecting dial 43 is depressed after selection of the cooking menu as described above or when the microcomputer 31 determines in the affirmative at step S13, the automatic cooking is executed in accordance with the selected cooking menu represented by LED 39 in actuation, at step S14.

Figure 15:
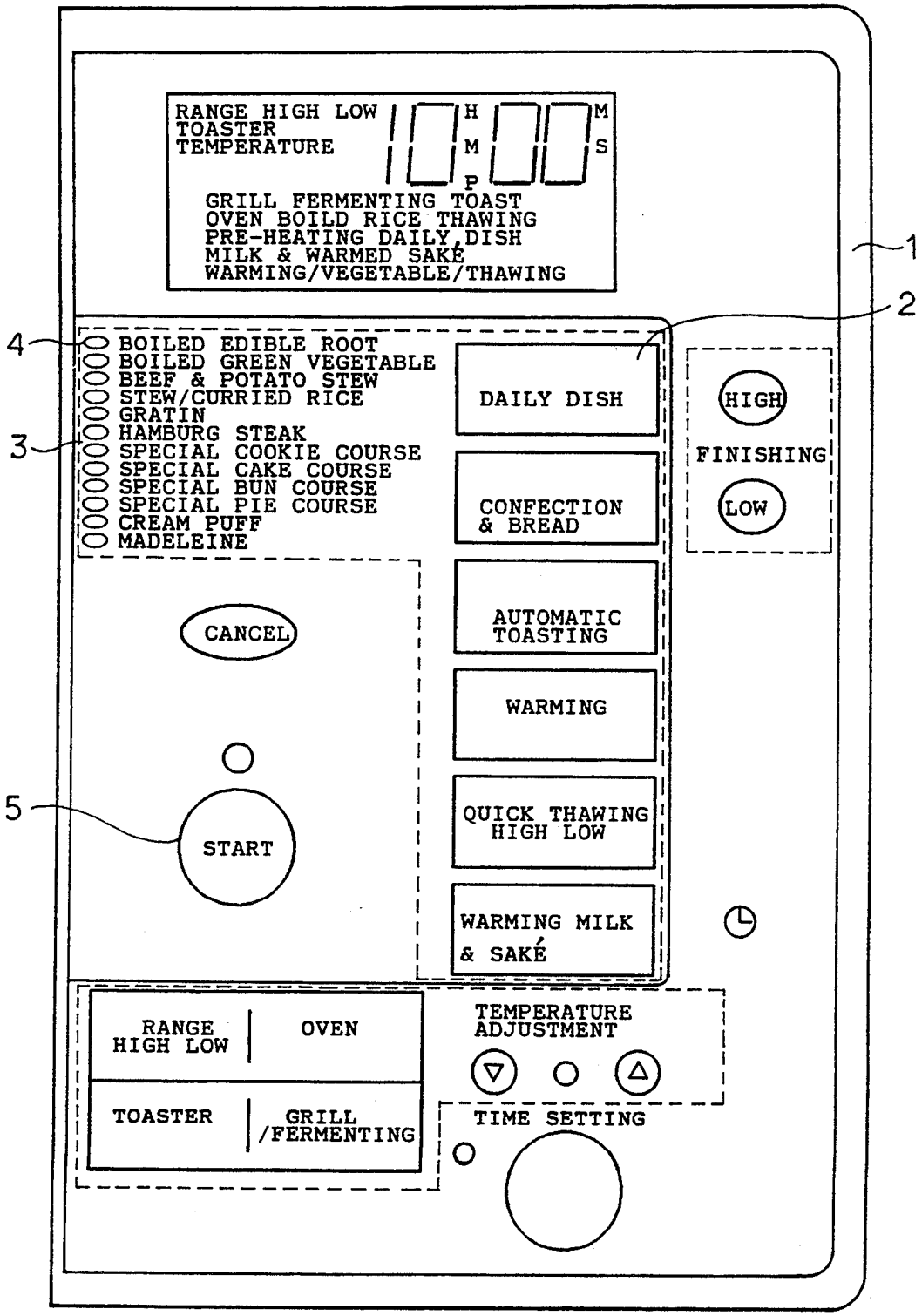
FIG.15 (PRIOR ART)
FIG. 15 is a view similar to FIG. 1 showing a prior art arrangement.

In accordance with the above-described embodiment, in selection of a desired cooking menu, only the backlight 38 corresponding to the cooking menu group to which the cooking menu to be selected belongs is actuated so that the cooking menu group is illuminated from behind. In this regard, the contents displayed on the menu display section 3 (see FIG. 15) are complicated in the prior art such that the user has some difficulty in selecting the desired cooking menu. In the above-described embodiment, however, a necessary part of the cooking menus is displayed relatively brightly even on the cooking menu display section 37 including a number of cooking menus. Consequently, the contents displayed on the display section 37 is visible to the user and the operation for the selection of the cooking menu can be performed readily.

The menu selecting dial 43 is turned for the selection of the cooking menu in the above-described embodiment while the selecting key 2 (see FIG. 15) needs to be operated many times in the prior art. Consequently, the cooking menu selecting operation can be performed further readily. Furthermore, since the single menu selecting dial 43 functions as a plurality of selecting keys 2 and a start switch in the embodiment, the number of parts mounted on the operation panel 35 can be reduced, which can render the cooking menu display section 37 large-sized. Consequently, the contents displayed on the display section 37 is further visible to the user. Furthermore, the operation panel 35 can be rendered small-sized.

Although the desired cooking menu is selected by turning the menu selecting dial 43 in the foregoing embodiment, a selecting key may be depressed for that purpose instead.

Figure 14:
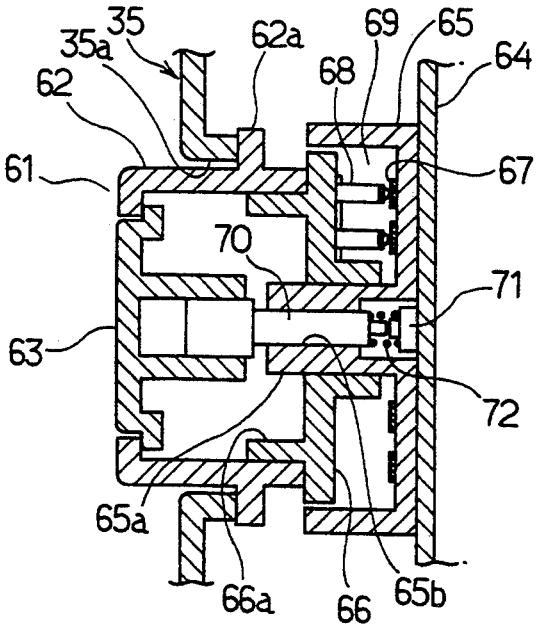
FIG. 14 is a longitudinally sectional side view of the menu selecting dial of the microwave oven in accordance with a third embodiment.

FIG. 14 illustrates a third embodiment of the invention. The difference between the foregoing second embodiment and the third embodiment will be described. A menu selecting dial 61 employed for the dial 43 comprises a rotatively moved member 62 having a short cylindrical shape and an independent depressed member 63 mounted inside the rotatively moved member 62. The rotatively moved member 62 is inserted, for rotative movement, in the circular mounting hole 35*a* formed in the operation panel 35. A flange 62*a* is formed on the outer periphery of the rotatively moved member 62 for the purpose of preventing the dial 61 from falling off. A printed wiring board 64 is mounted on the rear of the operation panel 35. The printed wiring board 64 has on its front a base 65 formed from an electrically insulative material. The base 65 has a portion 65*a* integrally protruded from its central front. A rotatively movable member 66 is mounted on the protruded portion 65*a* for rotative movement. Fixed contacts 67 are provided on the front of the base 65 and resilient movable contacts 68 are provided on the rear of the rotatively movable member 66. Thus, a pulse switch 69 comprises the rotatively movable member 66, the fixed contacts 67 and the movable contacts 68.

The rear end of the rotatively moved member 62 is fitted to an annular wall 66*a* protruded from the front of the rotatively movable member 66 so that the members 62 and 66 are rotatively moved together. In this regard, the rotatively moved member 62 (the rotatively movable member 66) is rotatively moved such that the movable contacts 68 are brought into contact with the respective fixed contacts 67. Consequently, the pulse switch 69 generates a pulse signal in accordance with the angle of rotation of the rotatively movable member 62 (the menu selecting dial 61), which pulse signal is supplied via the menu and time setting circuit 49 to the microcomputer 31.

The protruded portion 65*a* of the base 65 has a through-hole 65*b* formed in it. A bar-shaped operation member 70 extends through the hole 65*b* so as to be moved back and forth. A start switch 71 is provided on the front of the printed wiring board 64 so as to correspond to the rear end of the operation member 70. A coil spring 72 is interposed between the operation member 70 and the start switch 71 so that the operation member 70 is usually urged forward by the coil spring 72. The front end of the operation member 70 is fitted to the depressed member 63. The start switch 71 is usually off and it is turned on when the depressed member 63 (the menu selecting dial 61) is depressed so that the operation member 70 is moved backward. The switch signal generated by the start switch 71 is supplied via the key switch circuit 50 to the microcomputer 31.

The same effect can be achieved in the third embodiment as that in the second embodiment. Since the menu selecting dial 61 comprises the rotatively moved member 62 and the independent depressed member 63 mounted inside the member 62 in the third embodiment particularly, the central depressed member 63 is not rotatively moved with the rotatively moved member 62 when it is rotatively moved. Consequently, characters or a figure provided on the front of the depressed member 63 for indicating the cooking initiation is not turned, which can improve the design of the menu selecting dial 61.

The foregoing disclosure and drawings are merely illustrative of the principles of the present invention and are not to be interpreted in a limiting sense. The only limitation is to be determined from the scope of the appended claims.

We claim:

1. A heating apparatus comprising:

a) menu display means for displaying a plurality of cooking menus divided into a plurality of groups, each group including a plurality of cooking menus;

b) a menu selecting dial connected to the menu display means so that when rotatively moved in one of two directions, one of the cooking menu groups displayed on the menu display means is selected and so that when rotatively moved in the other direction, one cooking menu is selected from the selected cooking menu group;

c) heating means for heating food to be cooked; and d) heating control means connected to the heating means and the menu selecting dial for controlling the heating means so that a heating operation is automatically executed in accordance with the cooking menu selected by rotative movement of the menu selecting dial.

2. A heating apparatus of claim 1 wherein the menu display means has light transmissibility and which further comprises light-emitting elements provided on the menu display means each one identifying a cooking menu respectively, backlights provided on a back face of the menu display means for illuminating the cooking menu groups respectively from behind the menu display means, and display control means for actuating the light-emitting element corresponding to the cooking menu selected by the rotative movement of the menu selecting dial and actuating the backlight corresponding to the cooking menu group to which the selected cooking menu belongs.

3. A heating apparatus comprising:

a) menu display means for displaying a plurality of cooking menus divided into a plurality of groups, each group including a plurality of cooking menus, the menu display means having light transmissibility;

b) light-emitting elements provided on the menu display means each one identifying a cooking menu respectively;

c) backlights provided on a back face of the menu display means for illuminating the cooking menu groups respectively from behind the menu displaying means;

d) a menu selecting dial connected to the menu display means so that one of the cooking menus is selected when rotatively moved;

e) display control means connected to the light-emitting elements and the backlights for actuating the light-emitting element corresponding to the cooking menu selected by the rotative movement of the menu selecting dial and actuating the backlight corresponding to the cooking menu group to which the selected cooking menu belongs;

f) heating means for heating an object to be cooked; and g) heating control means connected to the heating means and the menu selecting dial for controlling the heating means so that a heating operation is automatically executed in accordance with the cooking menu selected by rotative movement of the menu selecting dial.

4. A heating apparatus of claim 3, wherein the menu selecting dial at least has a central depressible portion and heating is initiated when the central depressible portion of the menu selecting dial is depressed.

5. A heating apparatus of claim 4, wherein the menu selecting dial comprises a generally annular rotatively operated section rotatively moved and a depressibly operated section provided inside the rotatively operated section.

6. A heating apparatus of claim 4, further comprising cooking mode switching means for switching a cooking mode between automatic and manual cooking modes and cooking time setting means connected to the menu selecting dial and the cooking mode switching means for setting a cooking time period by the rotative movement of the menu selecting dial when the manual cooking mode has been selected by the cooking mode switching means.

7. A heating apparatus of claim 6, further comprising dial function indicating means for indicating that the menu selecting dial has been operated either for the cooking menu selection or for the setting of the cooking time period and function indicating means connected to the cooking mode switching means for controlling the dial function indicating means in accordance with the switching operation of the cooking mode switching means.

8. A heating apparatus of claim 3, wherein the menu display means has a panel on which the menu selecting dial is mounted to be rotatively moved and depressible and the heating control means controls the heating means so that the heating operation is initiated when the menu selecting dial is depressed.

* * * * *